United States Patent [19]

Erickson

[11] Patent Number: 4,562,928

[45] Date of Patent: Jan. 7, 1986

[54] DISPLAY RACK FOR FROZEN FOOD PACKAGES

[76] Inventor: Elton D. Erickson, 16 Otis St., Lowell, Mass. 01853

[21] Appl. No.: 653,882

[22] Filed: Sep. 25, 1984

[51] Int. Cl.[4] ..... A47F 5/00

[52] U.S. Cl. ..... 211/184; 108/61; 211/49.1; 211/181

[58] Field of Search ..... 211/49.1, 43, 184, 51, 211/134, 153, 181, 175, 59.2; 312/71, 116; 108/60, 61

[56] References Cited

U.S. PATENT DOCUMENTS

| | | | |
|---|---|---|---|
| 1,147,055 | 7/1915 | Vick | 211/50 |
| 1,598,467 | 8/1926 | Weeks | 211/43 |
| 1,674,359 | 6/1928 | Frey | 211/51 |
| 2,929,227 | 3/1960 | Rainwater | 312/116 X |
| 2,980,259 | 4/1961 | Fowds | 211/59.3 |
| 3,120,894 | 2/1964 | Conley | 211/43 |
| 3,138,262 | 6/1964 | Anders | 211/43 |
| 3,308,961 | 3/1967 | Chesley | 211/490 |

*Primary Examiner*—Robert W. Gibson, Jr.
*Attorney, Agent, or Firm*—Pearson & Pearson

[57] ABSTRACT

A frozen food package display rack for use on the wire grille shelves of frozen food cases, with wires running from side to side is preferably of metal and formed of a flat planar bottom plate resting on the shelf, a flat planar support plate upstanding at an angle of about eighty degrees from the front edge of the bottom plate, and at least two side by side punched out tabs in the bottom plate, which underlie one of the wires of the shelf and prevent rearward movement, but permit forward movement. The packages are supported in shingled formation, leaning against the support plate, so that the front is readable for impulse buying and the packages and rack can be bodily moved forward in the case by a special hook. The support plate and the tabs each extend in planes parallel to the wires of the grilled shelf of the case.

4 Claims, 5 Drawing Figures

DISPLAY RACK FOR FROZEN FOOD PACKAGES

BACKGROUND OF THE INVENTION

It has long been known to provide a sheet metal book end consisting of a flat, planar, horizontal bottom plate, from which an upstanding, inverted U shaped vertical, support plate, has been cut, or punched out, and bent upwardly, such book ends being slidable unless the weight of a book rests on a part of the bottom plate.

It is also known to form brackets of various types with attachment flanges having sharp pointed tabs punched, cut, or slit from the material thereof and bent outwardly therefrom, as exemplified in the following patents.

U.S. Pat. No. 3,090,588; Monette, May 21, 1963;

U.S. Pat. No. 3,223,246; Daitch; Dec. 14, 1965;

U.S. Pat. No. 3,601,428; Gilb; Aug. 24, 1971.

However, as far as I am aware, it has not been heretofore proposed in the prior art, by patent or commercially, to provide a rack suitable for displaying frozen food packages on the wire grille shelf of a frozen food case so that the packages are upstanding on one edge, facing forwardly so that the customer may readily read the front panel of each successive front package in the shingled formation of packages.

SUMMARY OF THE INVENTION

In this invention, a rack is provided preferably formed of sheet metal, with nothing to break or wear out, and consisting of a flat planar bottom plate which rests on the wire grille of the frozen food case and a flat planar support plate bent upwardly and inclined slightly rearwardly from the front edge of the bottom plate, preferably at about an angle of eighty degrees.

Each bottom plate includes at least two side by side, spaced apart, punched out, cut out, or slit out tabs of generally rectangular configuration, bent downwardly and rearwardly so as to pass through the space between a pair of adjacent grille wires, running from side to side of the case, and to then underlie the rear wire of the pair.

Thus, the support plate of the rack supports a plurality, or stack, of frozen food packages leaning thereagainst, and resting on one side edge and in shingled formation so that the front panel of the front package is visible and readable from the front of the case. The rack is not movable rearwardly because of its depending tabs, but a special hook is provided so that the rack and packages leaning thereagainst can be moved to the front of the case as the supply becomes depleted.

DESCRIPTION OF A PREFERRED EMBODIMENT

Figure 1:
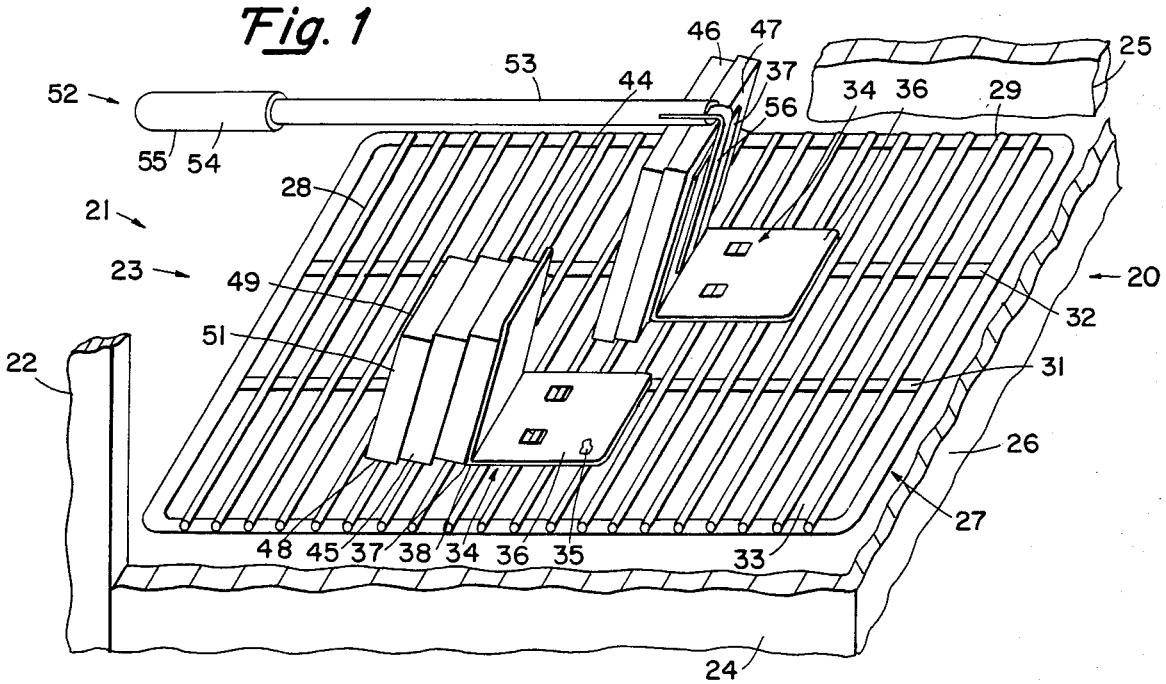
FIG. 1 is a fragmentary perspective view of the racks of the invention in use on a wire grille shelf in a frozen food case, one rack being moved forward by the special hook.
Figure 2:
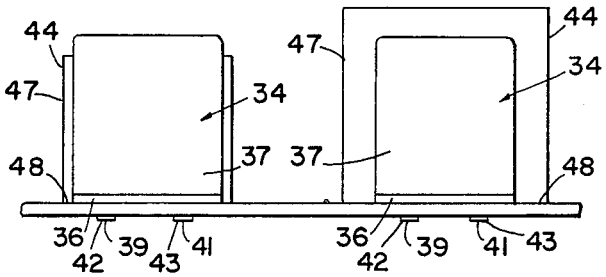
FIG. 2 is a rear elevation of a shelf, racks and frozen food packages.
Figure 3:
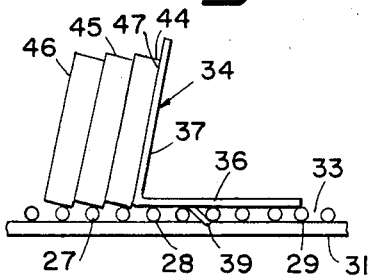
FIG. 3 is a side elevational view of a shelf, rack and packages.
Figure 4:
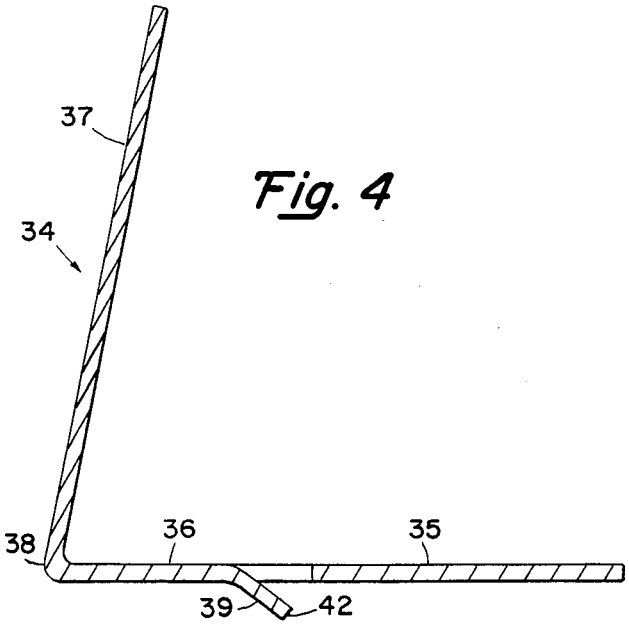
FIG. 4 is an enlarged side elevational view of one of the racks of the invention.
Figure 5:
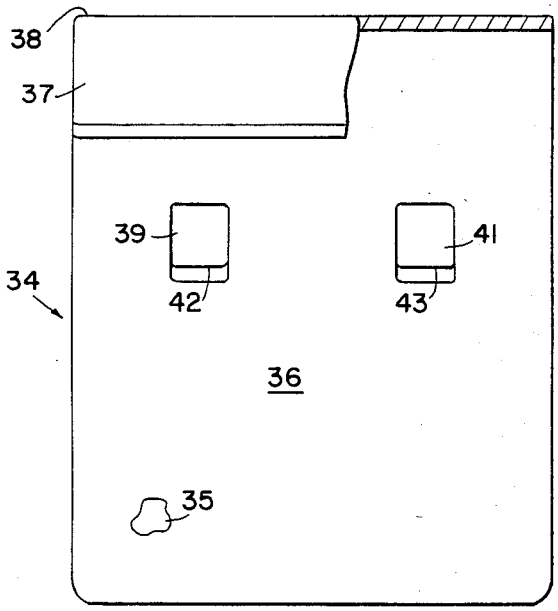
FIG. 5 is a top plan view of the rack shown in FIG. 4 with part broken away.

As shown in FIG. 1, a frozen food case 21, having a door 22, at the front 23, side walls 24 and 25, and a rear wall 26, is provided with one or more wire grille shelves 27, formed of a plurality of parallel wires such as 28 or 29, running from side to side and usually having a plurality of wire supports such as 31 and 32, normal thereto and running from front to back. The spaces between the parallel wires 28 or 29 are designated 33.

The one piece rack 34 of the invention is formed of sheet material such as metal 35, and comprises a flat planar bottom plate 36, which rests on the shelf 27, and an integral flat planar support plate 37, bent upwardly from the forward edge 38 of the bottom plate, preferably at an angle of about eighty degrees thereto, so as to tilt slightly rearwardly. The bottom plate 36 is provided with at least two integral tabs 39 and 41, punched, slit, or cut out of the material thereof and bent downwardly and rearwardly therefrom, each tab terminating in a blunt tip 42 or 43, and being generally rectangular in plan.

The blunt tipped, rectangular tabs 39 and 41 of each rack are shaped and dimensioned to pass through a space 33 between a pair of parallel wire 28 and 29 of the shelf 27, and to underlie the rear wire such as 29, to prevent rearward tilting or rearward movement of the rack, but to permit ready forward movement toward the front 23, of the case 21, to a new position anchored in a space between a new pair of wires.

The racks 34 support one or more frozen food packages such as 44, 45, and 46, in what I call shingled formation with the rear most package 44 having its rear panel 47 resting against the upstanding, rearwardly inclined support plate 37, the package leaning rearwardly and supported on one side edge 48, and the front panel 49, of the front package 51, of the stack clearly visible and readable through the transparent doors 22, of the case to encourage impulse buying.

As shown in FIG. 1 a special hook 52 is provided having an elongated shank 53, with a handle 54 at one end 55, and having the other end 56 angularly to the shank at an angle of about eighty degrees. When the supply of packages 44, 45, or 46 supported on a rack 34, becomes partially depleted, the store personnel may reach through door 22 into case 21, and pull the entire rack 34, with any packages supported thereon to the front of the shelf 27, by the hook 52.

In operation therefore, the frozen food packages in the case are quickly and easily positioned with their racks to face the front, thereby reducing labor cost, and increasing sales of the product. Customers can see the pictured product on the front panel of the front package supported by the rack, read the price, brand name, weight, and product title without moving the package or opening the door of the case to admit ambient air. The case always appears full to the front as the rack and packages are successively moved forward and the packages are always supported on edge, so long as the tabs of the racks releasably embrace one of the wires of the shelf.

The upwardly and rearwardly inclined support plate 37 and the downwardly and rearwardly inclined tabs 39 and 41 of each rack 34, extend in planes parallel to the wires 28 and 29 of the shelf 27. Thus, the rack can easily be drawn forwardly from wire to wire, but is prevented from rearward movement by the tabs.

I claim:

1. In combination with the wire grille shelves of a frozen food case, the wires of the grille shelves running from side to side, in parallelism with spaces therebetween, in said case, said rack comprising:

a one piece rack of sheet material having a flat planar base plate resting on said wires, a flat planar support plate upstanding from, and integral with, one edge of said base plate and extending in a plane parallel to said wires and at least two integral tabs, slit from the material of said base plate and bent downwardly and rearwardly therefrom, to both enter a space between adjacent said wires, said tabs being shaped and dimensioned to extend downwardly in a plane parallel to said wires and releasably embrace one of the wires of said grille to prevent tilt of said rack while said rack supports a plurality of frozen food packages upstanding on one edge in shingle formation.

2. In combination with a frozen food case having at least one grille shelf of wires running from side to side of said case, in parallelism, with spaces therebetween, said case having a front comprising:

a frozen food package display rack arranged to support a plurality of frozen food packages upstanding on one edge on said shelf in shingled formation to expose the front face of the front package;

said rack comprising a base plate adapted to rest on said wires of said shelf, and having at least two punched out, spaced apart tabs bent downwardly and rearwardly, in a plane parallel to said wires, into one of said spaces to engage and underlie one of said wires, but releasable therefrom by movement in a forward direction and comprising a support plate integral with said base plate and inclining upwardly and rearwardly from the forward edge thereof in a plane parallel with said wires to support said frozen food packages upstanding on one edge thereof in shingled formation with the front panel of the front package readable from the front of said case.

3. A combination as specified in claim 2 wherein:

said support plate inclines upwardly and rearwardly from said forward edge of said base plate at an acute angle of about eighty degrees from said base plate to tilt said packages slightly rearwardly.

4. A rack for displaying frozen food packages in combination with a grilled shelf of a frozen food case, said shelf formed of parallel wires with spaces therebetween, said rack comprising:

a flat, planar base plate adapted to rest on said grilled shelf and having at least two spaced apart punched out tabs extending downwardly between the wires of said grilled shelf into the space between a pair of adjacent parallel wires, and thence extending rearwardly to underlie one of the wires of said grille shelf to releasably anchor said plate against rearward movement on said shelf;

and a flat planar support plate integral with, and upstanding from the forward edge of said base plate, said support plate extending in a plane parallel to said wires and inclining rearwardly at an angle of about eighty degrees to support a plurality of frozen food packages upstanding on end, in shingled formation with their front panels readable from the front of said case.

* * * * *